US009049906B2

(12) United States Patent
Schmidt et al.

(10) Patent No.: US 9,049,906 B2
(45) Date of Patent: Jun. 9, 2015

(54) CLASP WITH DIFFERENT WRIST-BAND LENGTH ADJUSTMENTS

(71) Applicant: Montres Tudor S.A., Geneva (CH)

(72) Inventors: Gregory Schmidt, Pougny (FR); Jerome Tyrode, Gaillard (FR)

(73) Assignee: MONTRES TUDOR S.A., Geneva (CH)

( * ) Notice: Subject to any disclaimer, the term of this patent is extended or adjusted under 35 U.S.C. 154(b) by 26 days.

(21) Appl. No.: 13/722,215

(22) Filed: Dec. 20, 2012

(65) Prior Publication Data

US 2013/0160255 A1 Jun. 27, 2013

(30) Foreign Application Priority Data

Dec. 22, 2011 (EP) ..... 11405374

(51) Int. Cl.

| | |
|---|---|
| ***A44C 5/04*** | (2006.01) |
| ***A44C 5/24*** | (2006.01) |
| ***A44C 5/14*** | (2006.01) |

(52) U.S. Cl.

CPC . *A44C 5/246* (2013.01); *A44C 5/14* (2013.01); *Y10T 24/2155* (2015.01)

(58) Field of Classification Search

USPC ..... 24/71 J, 265 WS; 63/3.2, 9; 224/176

See application file for complete search history.

(56) References Cited

U.S. PATENT DOCUMENTS

| | | | | |
|---|---|---|---|---|
| 2,001,216 | A * | 5/1935 | Sand | 24/71 J |
| 2,126,263 | A * | 8/1938 | Kestenman | 24/71 J |
| 2,138,570 | A * | 11/1938 | Carlson | 24/71 J |
| 2008/0083101 | A1 | 4/2008 | Christian et al. | |

FOREIGN PATENT DOCUMENTS

| | | | |
|---|---|---|---|
| DE | 10 2005 005 834 | A1 | 8/2006 |
| EP | 1 908 366 | A1 | 4/2008 |
| EP | 2 361 523 | A1 | 8/2011 |
| JP | 7-289316 | A | 11/1995 |

* cited by examiner

*Primary Examiner* — Robert J Sandy
*Assistant Examiner* — Abigail Morrell
(74) *Attorney, Agent, or Firm* — Westerman, Hattori, Daniels & Adrian, LLP

(57) ABSTRACT

A wrist-band clasp including two cooperation elements (6, 35) intended to be connected with two respective ends of two separate parts of a wrist-band, this clasp including a first device for precise adjustment of the length of the wrist-band, characterized in that the clasp further includes a second device for elastic adjustment of the length of the wrist-band.

23 Claims, 6 Drawing Sheets

CLASP WITH DIFFERENT WRIST-BAND LENGTH ADJUSTMENTS

The present invention concerns a wristwatch clasp as well as a wrist-band and a wristwatch as such both comprising such a clasp.

PRIOR ART

There are several solutions for fastening the two parts of a watch wrist-band around the wrist of its wearer. The first solution is simple and consists in providing the ends of each part with cooperating means, for example in the form of a simple loop and a prong on one part cooperating with holes in the other part. Such a solution has the drawback that on opening the cooperating means the two parts of the wrist-band are immediately unfastened, leading to the risk of dropping the wristwatch.

To alleviate this drawback, another solution consists in providing an intermediate element of clasp type, disposed between the two wrist-band parts, which remains fastened to the ends of these two parts at all times. Such a clasp occupies two positions: a closed position, for wearing the watch, in which the wrist-band and the clasp extend around the perimeter of the wrist, having a total length enabling retention of the wristwatch, and an open position for increasing the length of the wrist-band and the clasp, separating the two ends of the two parts of the wrist-band, without detaching them from the clasp, to enable the hand to pass through and the watch to be removed. In this open configuration of the clasp, the two parts of the wrist-band are not unfastened, which minimizes the risk of dropping the watch.

In a solution with a clasp, there is generally a first adjustment of the position of the clasp relative to the wrist-band, referred to as the conventional adjustment. However, the final length obtained is often not perfect and not the optimum. For this reason existing clasps, like that described in the document EP0819391, are equipped with a solution enabling a second adjustment of the length of the wrist-band to be effected, complementing the first or conventional adjustment. This second adjustment is for refining the initial adjustment, by effecting a very slight modification of the length of the wrist-band through a very simple and user-friendly manipulation requiring no tools and no particular skill. This second adjustment, called the precision adjustment, notably enables the comfort of the wearer to be improved by allowing easy modification of the initial adjustment so as to alleviate any changes in the perimeter of the wrist, which depends for example on ambient temperature and the forces exerted by the arm of the wearer of the wrist-band.

However, the existing solutions employing a clasp are not suited to all conditions of use of the watch and remain inadequate, even though they make it possible to reduce the risk of dropping a watch. If the wearer of the wristwatch wishes to go diving, for example, they generally need to fix their watch over a wetsuit. Then, as the diver descends deeper, the increasing pressure significantly modifies the length of the perimeter of their wrist. In practice, existing clasp precision adjustments prove unsuitable in the case of such use of the watch for diving.

Finally, there is therefore a requirement for a solution enabling the wearing of a wristwatch that makes it possible to retain the advantages of the prior art at the same time as reducing its disadvantages.

This is why the invention aims to achieve some or all of the following objects.

A first object of the invention consists in proposing a solution for closing a watch wrist-band around the wrist of a wearer that minimizes the risk of dropping the watch.

A second object of the invention consists in proposing a solution for closing a watch wrist-band around the wrist of a wearer that enables optimum and user-friendly adjustment of the length of the wrist-band under all conditions of use of the watch, even when diving, for example.

BRIEF DESCRIPTION OF THE INVENTION

To this end, the invention consists in a clasp including two cooperation elements intended to be connected with two respective ends of two separate parts of a wrist-band, this clasp including a first device for precise adjustment of the length of the wrist-band, characterized in that the clasp further includes a second device for elastic adjustment of the length of the wrist-band.

The invention is specifically defined by the claims.

BRIEF DESCRIPTION OF THE FIGURES

These objects, features and advantages of the present invention will be explained in more detail in the following description of particular embodiments given by way of nonlimiting example and with reference to the appended figures, in which.

The invention is based firstly on a clasp permanently connected to the ends of two parts of a wrist-band to minimize the risk of dropping a wristwatch, as explained above. This clasp is then equipped with a first precision adjustment device, enabling small modifications of length for flexible adaptation to changes in the perimeter of the wrist and adaptation of its comfort. It is finally equipped with a second elastic adjustment device, on greater lengthwise amplitude, enabling greater variations of length to be addressed, automatically, to adapt to particular uses such as when diving, for example.

One particular embodiment of such a clasp will now be described in detail by way of nonlimiting example.

Figure 1:
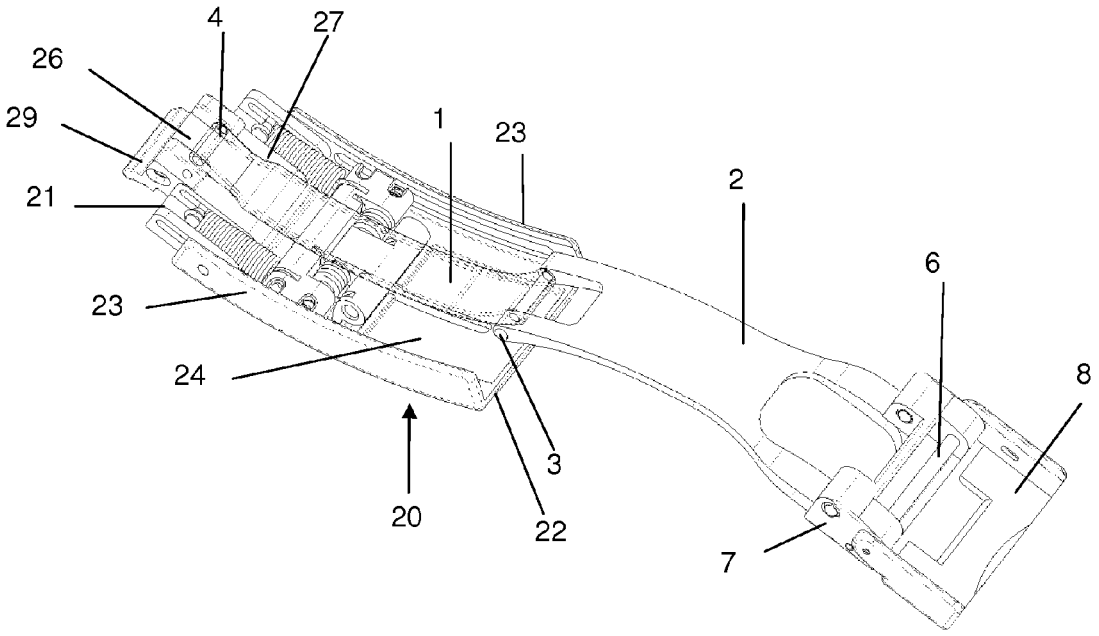
FIG. 1 represents a perspective view of a partially open clasp of one embodiment of the present invention.

As represented in FIG. 1, the clasp in this embodiment comprises two blades 1, 2 articulated to each other at the level of a connecting pin 3 forming a rotation pin, the first blade 1 being moreover articulated about a pin 4 to a first end 21 of a cover 20. The second blade 2 is provided at its end opposite its connection with the first blade 1 with a cooperation element 6 for fixing the end of a first wrist-band part, not represented.

The cover 20 includes an arrangement for fixing the end of a second wrist-band part, not shown, adapted to extend from the second end 22 of the cover 20. The latter also carries a member 27 on which is mounted an element 26 for fixing it to the first end 21 of the cover, intended to cooperate with the fixing element 7 of the second blade 2 to lock and unlock the clasp to obtain its two closed and open positions, in the conventional way.

Accordingly, in a known manner, the two blades 1, 2 can occupy two different configurations. In the open first configuration of the clasp, partially represented in FIG. 1, for example, the free end of the second blade 2 is released from its fixing to the cover 20, which enables deployment of the two blades 1, 2, which can be moved apart by rotation about the connecting pins 3, 4, enabling removal of the wristwatch from the wrist. In the closed second configuration of the clasp, represented in FIGS. 7 to 9, for example, the two blades are folded one onto the other and superposed with the cover 20, which conceals them. The latter cover thus also has an aesthetic function. In this closed position, the fixing element 7 of the second blade 2 cooperates with the fixing element 26 of the cover 20 to enable fixing thereof and closing and clamping of the assembly formed by the wrist-band and the clasp around the wrist. The closing and the release of the cooperation between the second blade 2 and the cover 20 are actuated with the aid of a holding member 29 rigidly fastened to the member 27. A latch 8 is also provided to make the closure of the clasp secure. This clasp mechanism is conventional and will not be described in more detail.

The cover 20 has two rims 23 that extend over substantially all its length, perpendicularly to its plane upper face forming a wall 24, to delimit a volume that incorporates adjustment devices of the clasp, which will be described in detail hereinafter, as well as parts of the two blades 1, 2 in the closed position of the clasp, as explained above, ensuring an attractive aesthetic of the clasp by concealing the components of these adjustment devices, which are not visible from the outside, from the visible upper face of the cover.

Figure 2:
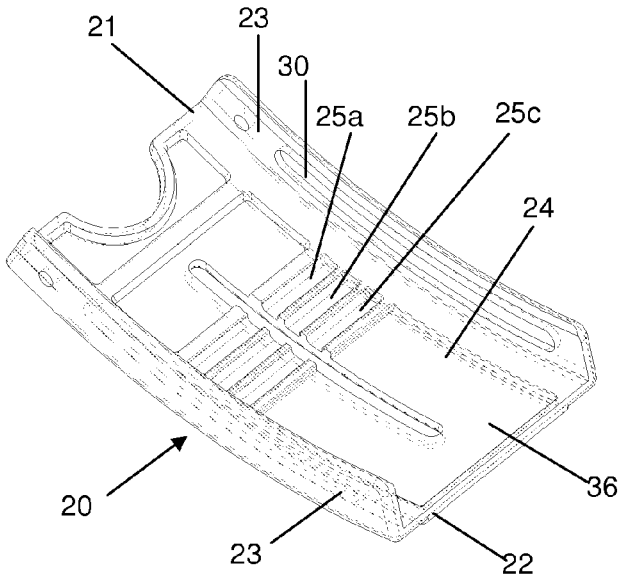
FIG. 2 represents a perspective view from below of the cover of the clasp in this embodiment of the present invention.
Figure 3:
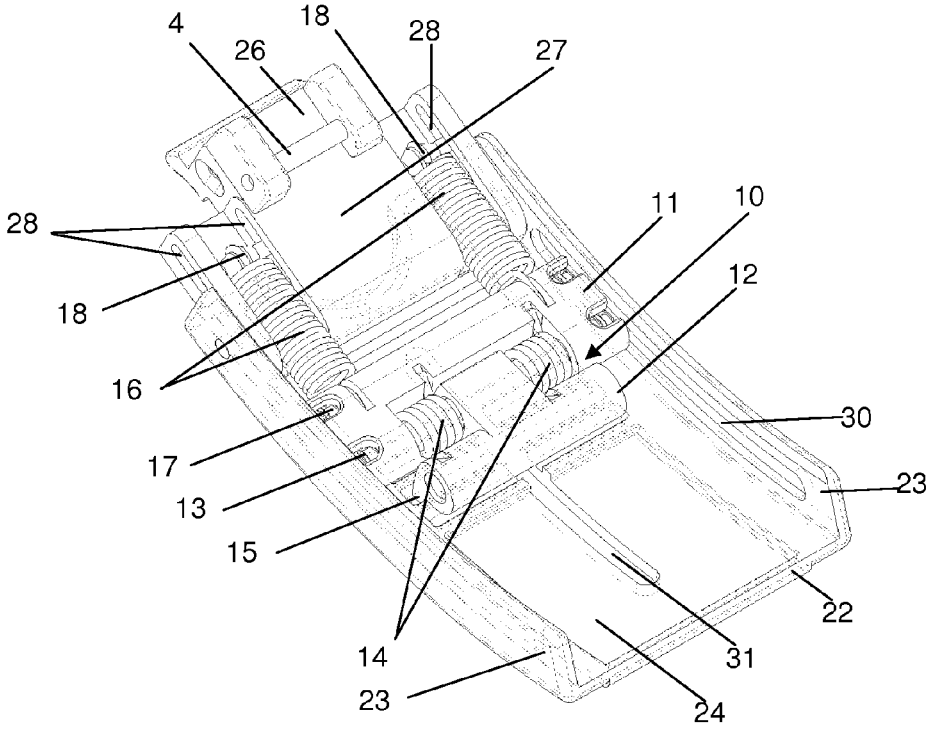
FIGS. 3 and 4 represent two different views of the arrangement of the adjustment devices of the clasp in this embodiment of the present invention.

The wall 24 extending between the two rims 23 of the cover 20, as can more particularly be seen in FIG. 2, includes notches, notably three notches 25*a* to 25*c*, recessed into its surface, intended to be oriented toward the wrist of its wearer. The interior volume of the cover 20 comprises devices for adjusting the length of the wrist-band, which can be seen particularly in FIGS. 3 to 6. To this end, it incorporates a wrist-band link 10, mounted to be mobile within this cover 20, which includes a carriage 11 and a catch 12 rotatably mounted about a connecting pin 13 on the carriage 11. The connection of the catch 12 to the carriage 11 is controlled by torsion springs 14 mounted on the connecting pin 13 that tend to maintain a tip 15 of the catch 12, which can more particularly be seen in FIGS. 6 to 9, in contact with the wall 24 of the cover 20, so as to cooperate with the notches 25*a* to 25*c*, as will be described in detail hereinafter.

Moreover, the carriage 11 is connected to the cover 20 by tension springs 16, a first end 18 of which is connected to the cover 20 and a second end of which is connected to the carriage 11, to be more precise to a pin 17 separate from the connecting pin 13 on which the catch 12 pivots. Their first end 18 is fixed so as to be mobile in translation by a transverse pin mechanism in which the ends of the pin are located in grooves 28 in the member 27 that is rigidly fastened to the cover 20 and disposed between its rims 23. The two pins 13, of the carriage 11 are parallel and extend the entire width of the cover 20 so that their ends cooperate with slides 30 provided within the rims 23 of the cover 20. By virtue of this connection, the carriage 11 is mobile relative to the cover 20, with a movement defined by the shape of the slides 30. This movement can be in any direction, close to a translation or be slightly curved. Moreover, the carriage may be subjected to a spring return force exerted by the tension springs 16, as will be explained hereinafter.

Figure 4:
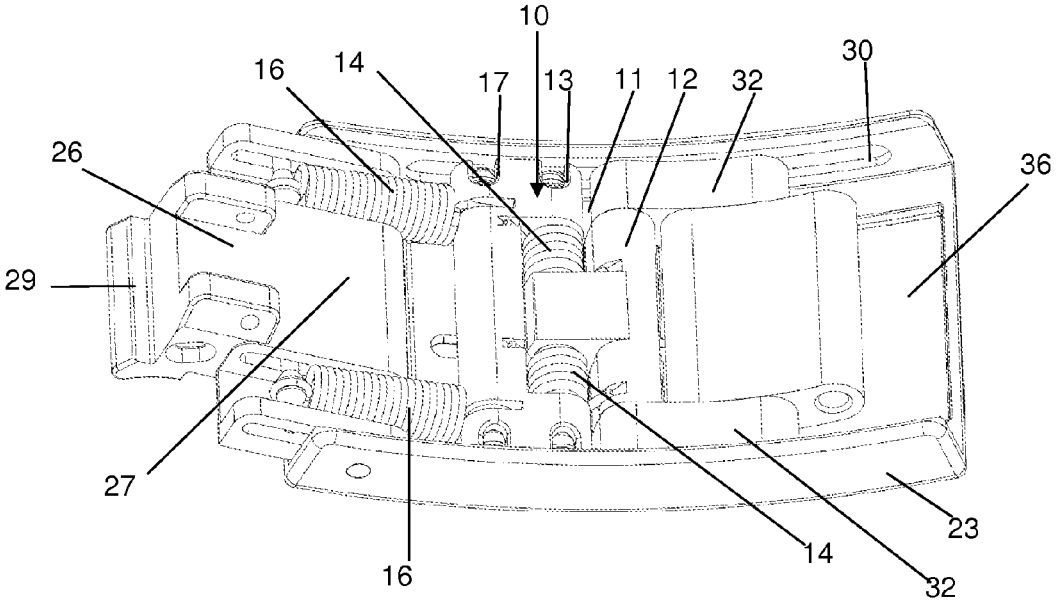
Figure 10:
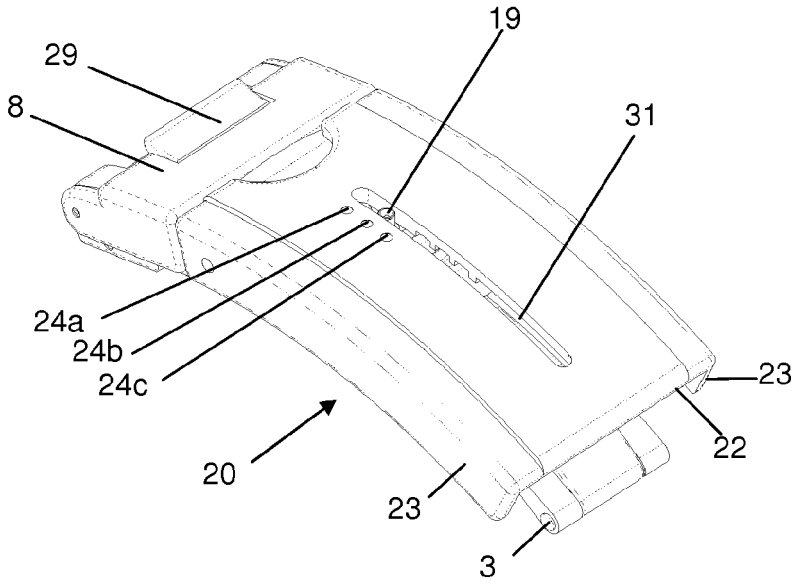
FIG. 10 represents a perspective view from above of the cover of the clasp in this embodiment of the present invention.

The length of a wrist-band cooperating with this clasp is adjusted by pivoting the catch 12 relative to the carriage 11, so as to move its tip 15 away from the cover 20 and to enable it to escape from its interengagement, if any, with a notch 25*a* to 25*c*. The link 10, i.e. the assembly formed by the carriage 11 and the catch 12, is then free to move relative to the cover 20 to allow adjustment of its position. In an advantageous optional embodiment, an indicator 19 is provided on the surface of this link, so as to appear in a longitudinal opening 31 provided in the wall 24 of the cover 20 and to cooperate with the visual markers 24*a*, 24*b*, 24*c* formed on the wall 24 of the cover 20, enabling the position of the link and thus the chosen adjustment of the length to be seen, as represented in FIG. 10. The ends 32 of a wrist-band part, which can be seen in FIG. 4, are fixed to the link 10, more particularly to the end of its catch 12, and thus allow movement of this wrist-band part relative to the cover, thereby to adjust the length of the wrist-band.

Figure 7:
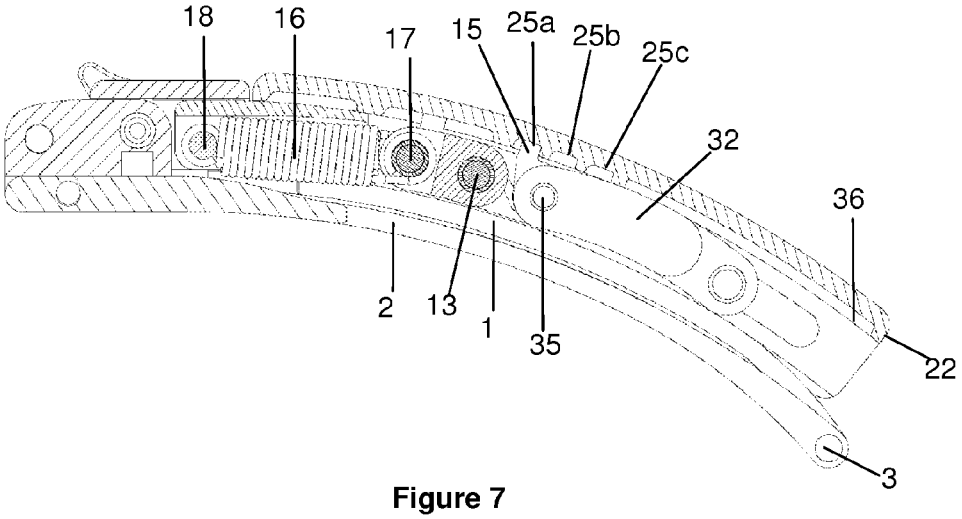
FIGS. 7 to 9 represent views in section of the clasp in different positions obtained by means of the first precision adjustment device in this embodiment of the present invention.
Figure 8:
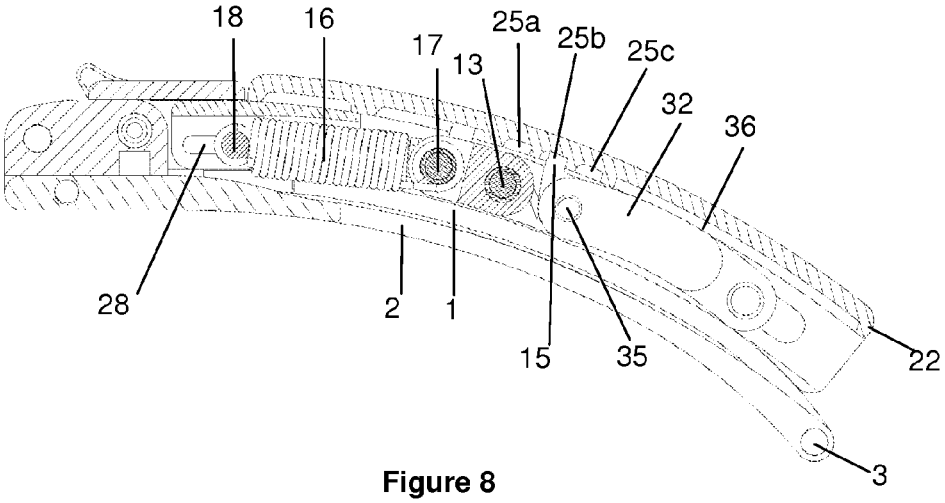
Figure 9:
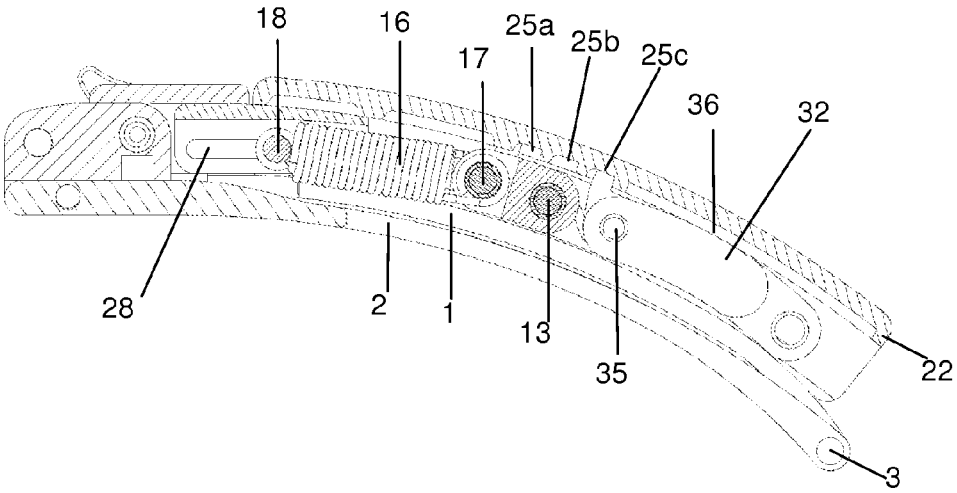

FIGS. 7 to 9 more particularly show the operation of the precision first adjustment. They represent the clasp in the closed position, with three respective different adjustments of the length of the wrist-band, effected by positioning the tip 15 of the catch 12 in the notches 25*a* to 25*c*, respectively. As can be seen in these figures, each notch 25*a* to 25*c* enables a different length of the wrist-band to be obtained because the ends 32 of the part are fixed to the two ends of the catch 12 via a cooperation element 35. The different notches are relatively close together, for example 2 mm apart, to enable precision fine adjustment of the length of the wrist-band. Any other number of notches greater than or equal to 2 may naturally be employed, and their spacing may equally vary, for example from 1 to 5 mm. Note that over this first travel of the carriage 11, and thus of the link 10, from the first position in the first notch 25*a*, represented in FIG. 7, to its final position in the final notch 25*c*, represented in FIG. 9, the end 18 of the tension springs 16 is moved from one end to the other of its guide grooves 28. The length of the latter is therefore chosen to correspond to the first travel of the carriage, itself defined by the distance between the ends of the adjustment notches 25*a* to 25*c*, which makes it possible for the tension spring 16 to remain at rest throughout the execution of the precision first adjustment and thus to simplify the manipulations carried out by the wearer. Moreover, this prevents fatigue of the tension springs 16. For each of the positions of this precision first adjustment, note that the link 10 that defines this adjustment is immobilized by one of the notches. As its release necessitates actuation of the catch 12 about its connecting pin 13, it is apparent that in the closed position of the clasp the blades 1, 2 that cover the adjustment elements prevent actuation of the catch 12 and contribute to locking the adjustment, as a safety measure. Nevertheless, even when opening the clasp, the catch 12 is retained in position, notably by the action of the torsion springs 14. This solution therefore has the advantage that the length adjustment chosen for the wrist-band is not lost on opening the clasp, which enables a user to take off their watch and put it on again without needing to repeat a previous adjustment.

Figure 5:
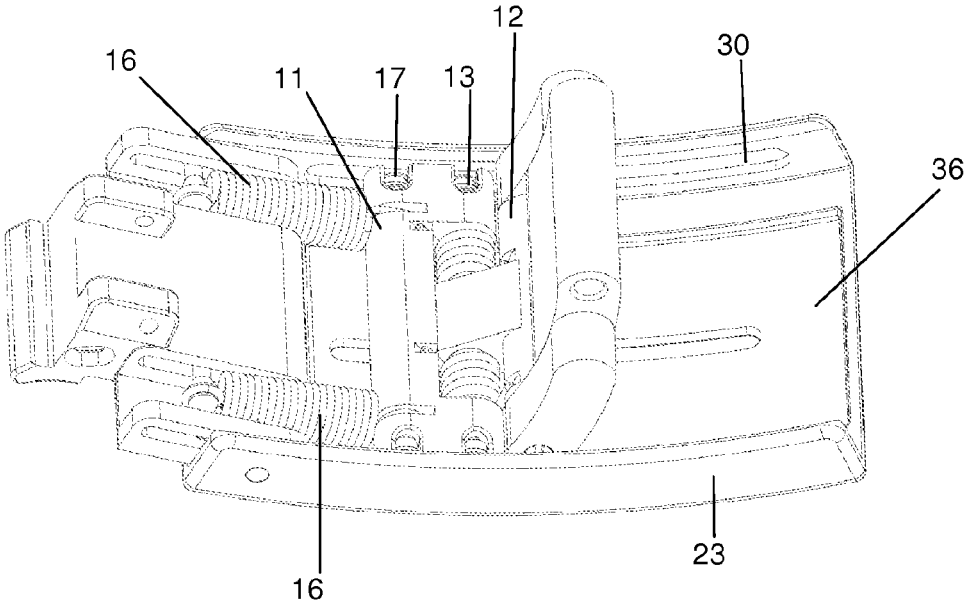
FIGS. 5 and 6 respectively represent a perspective view and a view in section of the arrangement of the adjustment devices of the clasp during the adjustment phase in this embodiment of the present invention.
Figure 6:
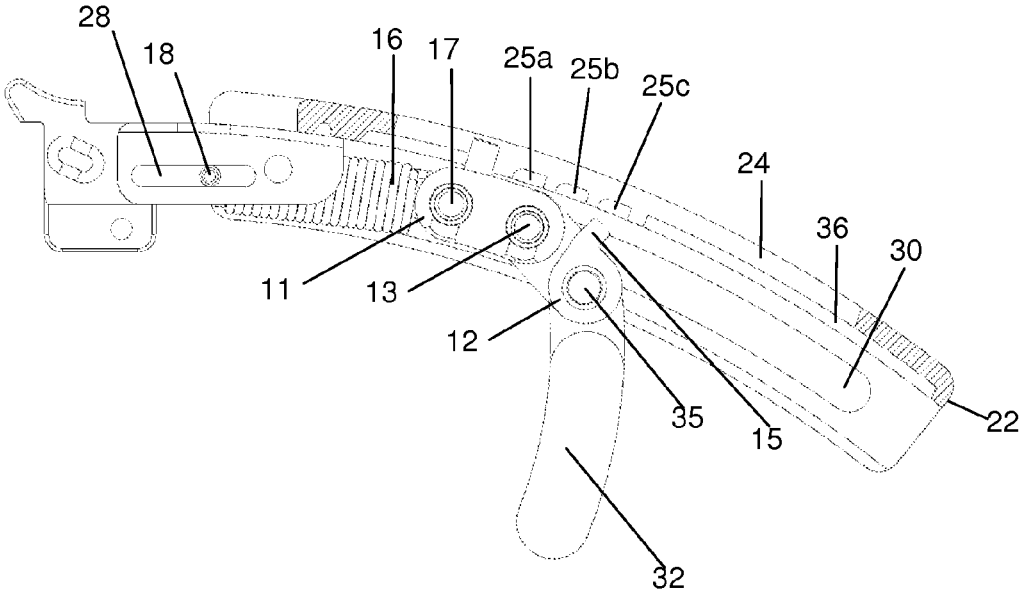

The adjustment of the length of the wrist-band is more particularly represented in FIGS. 5 and 6, respectively as seen from below and from the side. When the clasp is open, its two blades 1, 2 are moved away from the cover 20 and allow access to the catch 12. The latter is pivoted about its connecting pins 13 with the carriage 11 until its tip 15 escapes from one of the notches 25*a* to 25*c*. The carriage 11, and even the whole of the link 10, is then mobile relative to the cover 20, being guided along the lateral slides 30 referred to above. This movement of the link simultaneously drives the ends 32 of the wrist-band part connected to it. Note that the catch 12 and the end of the wrist-band part that is connected to it are oriented in a direction substantially perpendicular to the upper wall 24 of the cover during this adjustment phase, which enables user-friendly manual holding of them to drive movement of the whole of the link 10 easily to effect the adjustment. It then remains only to release the catch 12 for it to be repositioned automatically toward the wall 24 of the cover, in alignment with the carriage 11, which remains mobile until a notch 25*a* to 25*c* is reached, whereupon the tip 15 of the catch is engaged therein automatically by the torsion springs.

Figure 11:
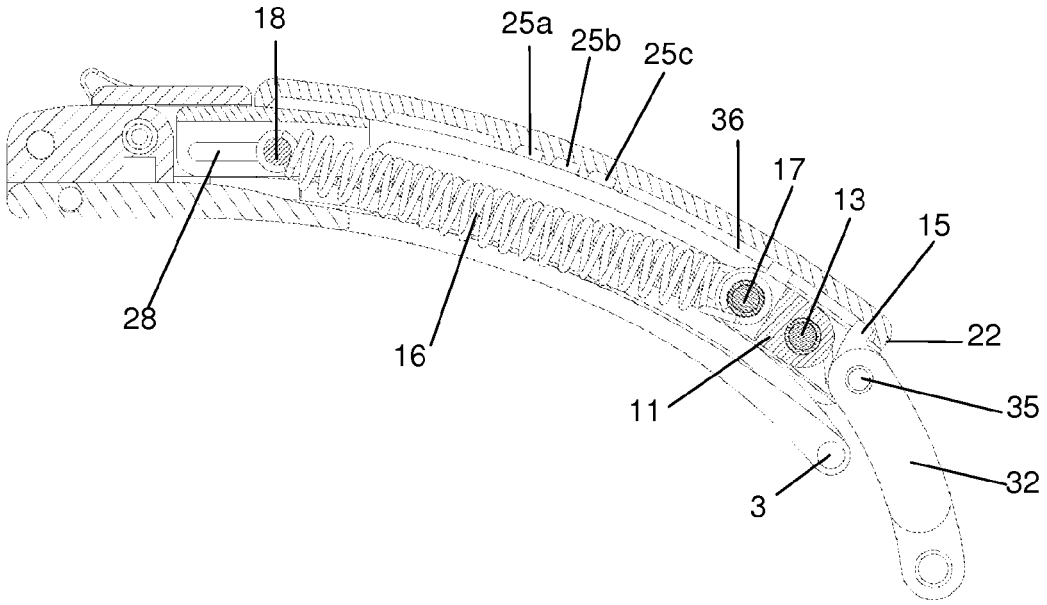
FIGS. 11 to 13 represent views in section of the clasp in different positions obtained by means of the second elastic adjustment device in this embodiment of the present invention.
Figure 12:
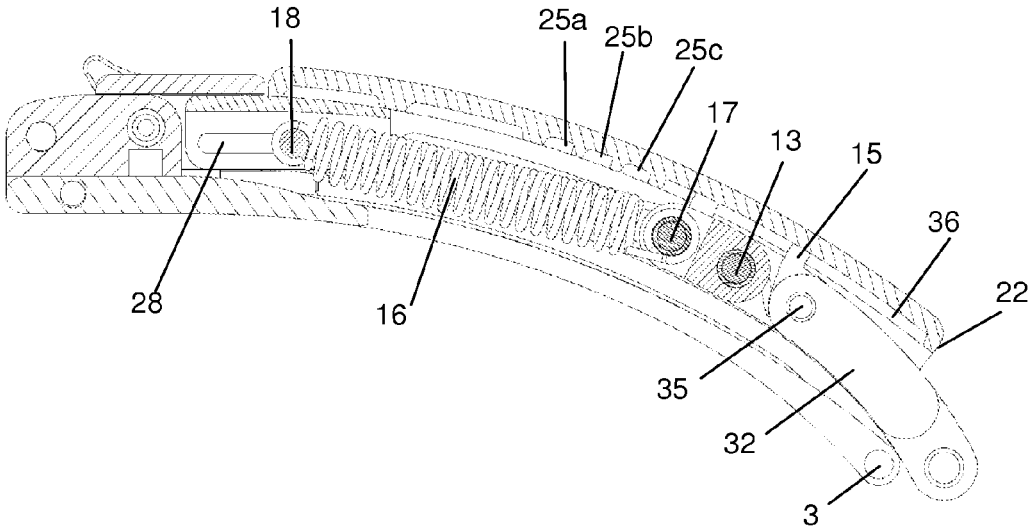
Figure 13:
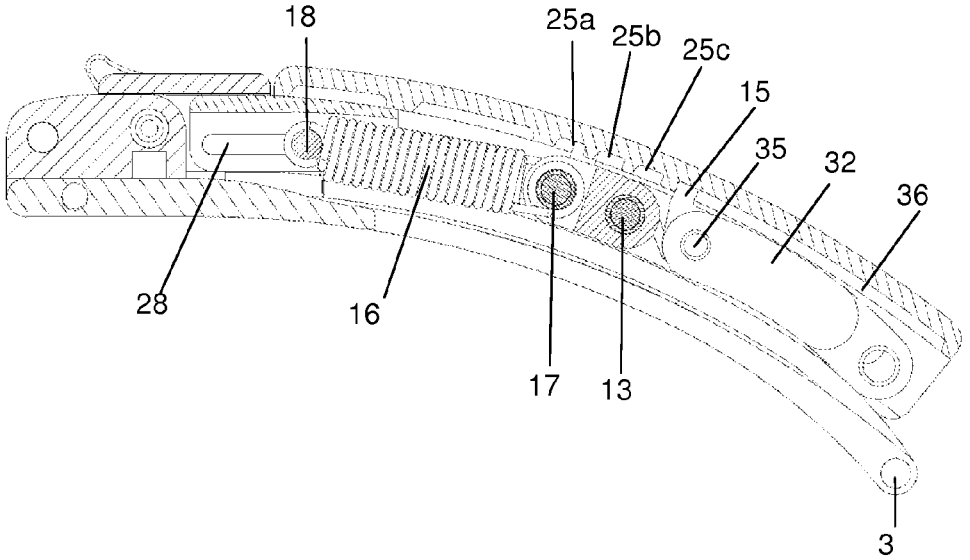

FIGS. 11 to 13 show more particularly the elastic second adjustment of the length of the wrist-band, for example in order to go diving. During this adjustment, the link 10 occupies a position beyond the area of the notches 25*a* to 25*c* mentioned above, in the direction of the end 22 of the cover, and moves over a second travel between this end 22 and the final notch 25*c*. Along this travel of the link the tip 15 of the catch 12 no longer cooperates with the notches, but moves in a continuous hollow area 36 of the interior surface of the cover, and the link 10 is free to move relative to the cover 20, guided by the slides 30. It is moreover subjected to the spring return force of the tension springs 16, the end 18 of which is now abutted on the cover 20.

FIG. 11 shows by way of example a first position of the link, enabling the longest length of the wrist-band to be obtained. To this end, the link is in its position nearest the end 22 of the cover 20. This position is reached, for example, when a user fits their watch over a wet suit on the surface of the water.

Thereafter, as the diver descends, the pressure induces reduction of their wrist measurement. Thanks to the elastic second adjustment device, the link is moved automatically by the return force of the tension springs 16, which work in traction over all of this second travel of the link, so that the wrist-band always remains the same length as the wrist. The traction force of the springs is defined to represent a good compromise to achieve at the same time good retention and comfortable wearing of the wristwatch. FIGS. 12 and 13 show two different intermediate positions for achieving this, in which the link 10 has been moved over its second travel by the tension springs 16, in the direction that reduces the length of the wrist-band. This second travel ends when the tip 15 of the catch 12 comes to abut against the exterior wall of the final notch 25*c* of the precision first adjustment device, as represented in FIG. 13. This second travel of the link can be of the order of 15 mm, preferably between 10 and 20 mm, or even between 5 and 25 mm. Note that in the position represented in figure of this second adjustment, the tension springs 16 are very slightly stretched in this embodiment.

Finally, as has been explained, the clasp of this embodiment of the invention has the advantage of combining two different and complementary adjustment functions, with the aid of two adjustment devices, offering a very wide and user-friendly range of use of the wristwatch. In the embodiment described, the two adjustment devices comprise some common components and separate other components. The clasp further comprises a conventional initial first fixing of the wrist-band, before carrying out the two adjustments described in detail above.

Naturally, many of the components of these adjustment devices could take a different form. For example, the link could take another form, its carriage could move differently and/or through different means of cooperation with the cover. Moreover, the catch can take any other form, such as a simple lever. Likewise, the tip/notch cooperation has been illustrated by way of example but any other equivalent connection may be envisaged, such as a connection of the tooth/rack type, stud/opening type, etc. The link can comprise any elastic member tending to press a link fixing element toward a complementary fixing element provided on the clasp. Moreover, the torsion springs 14 and the tension springs 16 could be replaced by any other equivalent elastic element. The elastic element contributing to the force returning the link along its second travel for effecting the elastic second adjustment could be fixed differently. In particular, its first end could be fixed, not mobile, in a simplified form of execution. Generally speaking, the architecture of the clasp itself can be different.

The invention has been illustrated on the basis of a wrist-band associated with a wristwatch, to which in itself this invention also relates. Alternatively, the clasp can be associated with any other wrist-band, for any object to be fixed to a wrist or any other part. This object can be a diving accessory such as a depth-meter or a diving computer, for example, or a jewelry component.

The invention claimed is:

1. A wrist-band clasp comprising:

first and second clasp elements intended to be connected with two respective ends of two separate portions of a wrist-band, said first and second clasp elements cooperating with each other, wherein the first clasp element is mobile with respect to the second clasp element over a first travel range so as to allow a precise adjustment of a length of the wrist-band, and the first clasp element is mobile with respect to the second clasp element over a second travel range so as to allow an elastic adjustment of the length of the wrist-band, wherein the second travel range does not overlap the first travel range, wherein the first clasp element comprises a mobile link to which is rigidly fastened a cooperation element for fixing a wrist-band part to the first clasp element, wherein the mobile link is mobile relative to the second clasp element over the first travel range and the second travel range, wherein (i) over the first travel range, the mobile link can be rigidly fastened to the second clasp element at a plurality of different fixing points so as to perform the precise adjustment, wherein the mobile link can be immobilized with respect to the second clasp element to set the precise adjustment, and (ii) over the second travel range, the mobile link is subjected to a returning tension force of an elastic connection so as to perform the elastic adjustment, in order to provide permanent elastic retention of the wrist-band around a wrist and automatic movement by spring return of the mobile link over the second travel range.

2. The wrist-band clasp as claimed in claim 1, wherein the mobile link comprises a carriage mobile relative to the second clasp element, and a catch mobile relative to the carriage between (i) a closed position in which, in the first travel range, the mobile link is configured to be fixed to the second clasp element at one of the fixing points, wherein the mobile link is immobilized with respect to the second clasp element to set the precise adjustment, and (ii) an open position in which the mobile link is always mobile relative to the second clasp element.

3. The wrist-band clasp as claimed in claim 2, wherein the mobile link is configured to move relative to the second clasp element in the second travel range with the catch in the closed position relative to the carriage.

4. The wrist-band clasp as claimed in claim 2, wherein the catch includes a fixing element selected from the group consisting of a tip, a tooth, a stud, an opening and a notch, wherein the fixing element of the catch cooperates with a complementary fixing element provided on the second clasp element in the catch.

5. The wrist-band clasp as claimed in claim 4, wherein the mobile link includes an elastic element tending to press the fixing element of the mobile link toward the complementary fixing element provided on the second clasp element.

6. The wrist-band clasp as claimed in claim 2, wherein the catch is rotatable relative to the carriage.

7. The wrist-band clasp as claimed in claim 1, wherein the mobile link includes a fixing element for fixing the mobile link to the second clasp element in the first travel range, wherein the fixing element forms an abutment for the mobile link relative to the second clasp element at an end of the second travel range.

8. The wrist-band clasp as claimed in claim 1, wherein the mobile link is connected to the second clasp element by the elastic connection, wherein the elastic connection includes a first connecting element mobile relative to the second clasp element so as to define a third travel range of the first connecting element, and a second elastic connecting element between the first connecting element and the mobile link.

9. The wrist-band clasp as claimed in claim 8, wherein the first connecting element of the elastic connection includes a pin rigidly fastened to the second elastic connecting element and mobile in a slide or groove of the second clasp element.

10. The wrist-band clasp as claimed in claim 8, wherein the third travel range of the first connecting element corresponds to the first travel range of the mobile link, and the first connecting element of the elastic connection comes to abut against and remains fixed relative to the second clasp element during the movement of the mobile link over the second travel range of the mobile link, during which the elastic connection is stretched and exerts the returning tension force on the mobile link.

11. The wrist-band clasp as claimed in claim 8, wherein the elastic connection includes at least one tension spring.

12. The wrist-band clasp as claimed in claim 1, wherein the second clasp element forms a cover of the clasp and comprises slides or groves forming guide elements in lateral flanges of the cover, and the mobile link is mobile inside the cover in the guide elements.

13. The wrist-band clasp as claimed in claim 1, wherein the mobile link includes an indicator visible via an opening in the second clasp element to indicate a position of the mobile link.

14. The wrist-band clasp as claimed in claim 1, further comprising at least two articulated blades, so that the two opposite ends of the articulated blades are a first distance apart in a closed configuration of the clasp and a second distance apart in an open second configuration of the clasp, the second distance being greater than the first distance, in order to enable removal of a wristwatch from a wrist or placing a wristwatch on a wrist.

15. The wrist-band clasp as claimed in claim 1, wherein when the first clasp element is in the first travel range, at least one of (i), the first clasp element remains stable during opening of the clasp, and (ii) the first clasp element is locked relative to the second clasp element by closing the clasp.

16. The wrist-band clasp as claimed in claim 1, wherein the wrist-band is suitable for diving.

17. The wrist-band clasp comprising two parts, wherein the two parts are connected to the wrist-band clasp as claimed in claim 1.

18. A wristwatch including a wrist-band, wherein the wrist-band is connected to the wrist-band clasp as claimed in claim 1.

19. A wrist-band clasp comprising:

first and second clasp elements intended to be connected with two respective ends of two separate portions of a wrist-band, said first and second clasp elements cooperating with each other, wherein the first clasp element is mobile with respect to the second clasp element over a first travel range so as to allow a precise adjustment of a length of the wrist-band, and the first clasp element is mobile with respect to the second clasp element over a second travel range so as to allow an elastic adjustment of the length of the wrist-band, wherein the second travel range does not overlap the first travel range, wherein the first clasp element comprises a mobile link to which is rigidly fastened a cooperation element for fixing a wrist-band part to the first clasp element, wherein the mobile link is mobile relative to the second clasp element over the first travel range and the second travel range, wherein (i) over the first travel range, the mobile link can be rigidly fastened to the second clasp element at a plurality of different fixing points so as to perform the precise adjustment, and (ii) over the second travel range, the mobile link is subjected to a returning tension force of an elastic connection so as to perform the elastic adjustment, in order to provide permanent elastic retention of the wrist-band around a wrist and automatic movement by spring return of the mobile link over the second travel range, wherein the mobile link is connected to the second clasp element by the elastic connection, wherein the elastic connection includes a first connecting element mobile relative to the second clasp element so as to define a third travel range of the first connecting element, and a second elastic connecting element between the first connecting element and the mobile link.

20. The wrist-band clasp as claimed in claim 19, wherein the first connecting element of the elastic connection includes a pin rigidly fastened to the second elastic connecting element and mobile in a slide or groove of the second clasp element.

21. The wrist-band clasp as claimed in claim 19, wherein the third travel range of the first connecting element corresponds to the first travel range of the mobile link, and the first connecting element of the elastic connection comes to abut against and remains fixed relative to the second clasp element during the movement of the mobile link over the second travel range of the mobile link, during which the elastic connection is stretched and exerts the returning tension force on the mobile link.

22. The wrist-band clasp as claimed in claim 19, wherein the elastic connection includes at least one tension spring.

23. A wrist-band clasp comprising:

first and second clasp elements intended to be connected with two respective ends of two separate portions of a wrist-band, said first and second clasp elements cooperating with each other, wherein the first clasp element is mobile with respect to the second clasp element over a first travel range so as to allow a precise adjustment of a length of the wrist-band, and the first clasp element is mobile with respect to the second clasp element over a second travel range so as to allow an elastic adjustment of the length of the wrist-band, wherein the second travel range does not overlap the first travel range, wherein the first clasp element comprises a mobile link to which is rigidly fastened a cooperation element for fixing a wrist-band part to the first clasp element, wherein the mobile link is mobile relative to the second clasp element over the first travel range and the second travel range, wherein (i) over the first travel range, the mobile link can be rigidly fastened to the second clasp element at a plurality of different fixing points so as to perform the precise adjustment, and (ii) over the second travel range, the mobile link is subjected to a returning tension force of an elastic element so as to perform the elastic adjustment, in order to provide permanent elastic retention of the wrist-band around a wrist and automatic movement by spring return of the mobile link over the second travel range, wherein the second clasp element forms a cover of the clasp and comprises slides or grooves forming guide elements in lateral flanges of the cover, and the mobile link is mobile inside the cover in the guide elements.

* * * * *